United States Patent [19]

Charlton et al.

[11] Patent Number: 4,904,308

[45] Date of Patent: Feb. 27, 1990

[54] ADJUSTABLE SMOKER'S MOUTHPIECE

[75] Inventors: John Charlton, Washington; Paul F. Clarke, South Shields, both of England

[73] Assignee: Cigarette Components Limited, London, United Kingdom

[21] Appl. No.: 92,203

[22] Filed: Sep. 2, 1987

[30] Foreign Application Priority Data

Sep. 2, 1986 [GB] United Kingdom ..... 8621156

[51] Int. Cl.[4] ..... A24F 5/00

[52] U.S. Cl. ..... 131/198.2; 131/198.1; 131/336

[58] Field of Search ..... 131/336, 198.1, 198.2

[56] References Cited

U.S. PATENT DOCUMENTS 3,486,508 12/1969 Sipos ..... 131/336
4,433,696 2/1984 Adams ..... 131/336
4,649,941 3/1987 Norman et al. ..... 131/198.2

*Primary Examiner*—V. Millin

*Assistant Examiner*—Jennifer L. Doyle

*Attorney, Agent, or Firm*—Cushman, Darby & Cushman

[57] ABSTRACT

A ventilated smoker's mouthpiece, e.g. for a cigarette, in which the degree of ventilation is readily adjustable. The mouthpiece includes a ventilating outer sleeve around a buccal end core member and an adjacent upstream core member longitudinally aligned therewith. The buccal end core member bus, extending upstream from its exposed end, a portion which is movable longitudinally relative to the remainder thereof to move the adjacent upstream core member longitudinally relative to the sleeve to vary the extent of ventilation permitted through the outer sleeve. Thus, the outer sleeve may have one or more ventilating orifices, with longitudinal movement of the adjacent upstream core member under the action of the movable portion of the buccal end core member, bringing the upstream core member at least partially into or out of blocking registration with the ventilation orifice or orifices, or altering the extent of such blocking registration, with the amount of ventilation permitted varying accordingly.

14 Claims, 4 Drawing Sheets

ADJUSTABLE SMOKER'S MOUTHPIECE

BACKGROUND OF THE INVENTION

The present invention relates to a ventilated smoker's mouthpiece, e.g. for a cigarette, in which the degree of ventilation is readily adjustable.

SUMMARY OF THE INVENTION

The invention provides such a mouthpiece comprising a ventilating outer sleeve around a buccal end core member and an adjacent upstream core member longitudinally aligned therewith, the buccal end core member having extending upstream from its exposed end a portion which is movable longitudinally relative to the remainder thereof to move the adjacent upstream core member longitudinally relative to the sleeve to vary the extent of ventilation permitted through the outer sleeve. Thus, the outer sleeve may have one or more ventilating orifices, with longitudinal movement of the adjacent upstream core member under the action of the moveable portion of the buccal end core member bringing the upstream core member at least partially into or out of blocking registration with the ventilation orifice or orifices, or altering the extent of such blocking registration, with the amount of ventilation permitted varying accordingly. In the mouthpiece as produced and supplied, prior to any adjustment, the buccal end and adjacent upstream core members will usually abut, although they could be spaced.

When the mouthpiece is for a cigarette, the ventilating outer sleeve is conveniently a ventilating tipping overwrap by which the mouthpiece is attached to the tobacco rod of the cigarette.

The buccal end core member may be a filtering or non-filtering member; thus it might have a body (e.g. a annular section) of conventional smoke filtering material with the moveable portion being of any suitable material and slidable relative thereto. Alternatively, the buccal end core member could have peripheral or internal passages extending from end to end thereof to allow the substantially free unfiltered passage of smoke or smoke and ventilating air. The moveable portion will usually be an inner (e.g. coaxial) core portion, but this is not essential. It should be a snug fit with the rest of the buccal end core member to avoid inadvertent dislodgement, but may have a smooth surface (e.g. a plastics wrap) to facilitate sliding.

The adjacent upstream core member could likewise be a filtering or non-filtering body, e.g. a conventional filtering plug or a body having passages from end to end thereof to provide for the substantially free unfiltered passage of smoke or smoke and ventilating air. To avoid unintended movement, it should be a snug fit in the ventilating outer sleeve or other immediately surrounding wrap or sleeve relative to which it slides, but it preferably has a smooth surface to facilitate controlled such sliding when operated on by the movable portion of the buccal end core member.

Suitably, the buccal end and adjacent upstream core members (each of which may itself include one or more wrappers) are provided with a common air-permeable wrap which is in turn, surrounded by the ventilating outer sleeve, the upstream core member being movable longitudinally relative to said common wrap and said outer ventilating sleeve. For ease of construction and retention of registration during construction, it is currently preferred in practice for the common wrap (or, in the absence of the latter, the outer ventilating sleeve) to be secured (e.g. adhered) to the buccal end core member and to an air-permeable wrap around the adjacent upstream core member and relative to which the latter core member within can slide. The adjacent upstream core member should be a snug fit within this permeable wrap to prevent inadvertent dislodgement (the wrap, for example, being applied to the member as a step in a conventional process for producing wrapped filter plugs). Sliding relative to the permeable wrap can be facilitated by making the member with a smooth (e.g. plastics) sleeve immediately within the wrap. Adhering the common wrap (or outer ventilating sleeve) as indicated above helps ensure that the remainder of the buccal end core member does not move when its movable portion is slid to shift the adjacent upstream core member.

In practice it is most convenient for the mouthpiece to include a third core member, longitudinally spaced upstream from the adjacent upstream core member and preferably combined with the buccal end and adjacent upstream core members by means permitting ventilation into the combination, this means may be provided by a highly ventilating plugwrap (which might be of highly air-permeable material, or have extensive vents—as in UK-A-2105171, to which attention is directed for further detail) or by one or more strips each extending only partially circumferentially around the core members and leaving a longitudinally extending ventilation gap or gaps between longitudinal strip edges. The outer ventilating sleeve of the mouthpiece would extend around this combination of core members. The third upstream core member, which would normally abut the tobacco rod when the mouthpiece is incorporated in a cigarette, could, like the buccal end and adjacent upstream core members, be a filtering or non-filtering body.

The ventilating outer sleeve, which (at least in the initially produced mouthpiece, prior to adjustment) can extend upstream beyond the buccal end and adjacent upstream core members, may be a tipping overwrap which also incorporates the mouthpiece in a cigarette. Instead, the mouthpiece could be an independent structure, attachable to a cigarette by ring tipping. The ventilating outer sleeve preferably has ventilating holes or gaps, which can be in any of a variety of arrangements and extents according to the degree of ventilation and ventilation adjustment to be permitted.

When the mouthpiece is a preformed coherent article for subsequent attachment to a smoking article (e.g. by ring tipping to a cigarette), it will preferably be produced as a continuous rod of the required and appropriately arranged core members, within a continuous ventilating outer sleeve, this rod being cut into finite lengths as it is continuously produced. This cutting may be into individual mouthpieces for supply to the cigarette manufacturer, but is usually into lengths which are multiples of individual mouthpieces, these multiple lengths being supplied to the cigarette manufacturer which cuts them into individual mouthpieces. The invention includes not only the individual mouthpieces, but also such continuous and multiple length rods—in which adjacent eventual individual mouthpieces are integrated in mirror image relationship within the common ventilating outer sleeve.

Particularly when the ventilating outer sleeve is a tipping overwrap incorporating the mouthpiece in a cigarette, but also in the above circumstances when the ventilating outer sleeve is part of the preformed mouthpiece, all or a part of the remainder of the mouthpiece may be a preformed sub-assembly. For example, the buccal end core member and adjacent movable upstream core member may be a preformed sub-assembly, united by common ventilating means—e.g. by a common porous wrap as in FIG. 2 below. Likewise, the buccal end core member, movable adjacent upstream core member (or a preformed sub-assembly thereof) and a third upstream core member can be a preformed sub-assembly united by common ventilating means—e.g. by a common highly ventilating plugwrap or partial plugwrap as in the sub-assembly of FIG. 3, described hereinbelow. Any such sub-assembly of core members and common ventilating means is preferably produced continuously, and continuously cut to finite lengths in a manner similar to that described above for continuous production of the mouthpiece. The invention also includes these sub-assemblies, and continuous and multiple length rods from which the sub-assemblies can be cut and in which adjacent individual sub-assemblies are integrally united in mirror image relationship within continuous ventilation means.

Each individual core can be produced in conventional manner, by continuous production of the corresponding rod which is cut into appropriate lengths for the above described continuous production of the mouthpiece and/or its sub-assemblies.

It is to be noted that, at least when unqualified, the terms "sleeve", "wrapper", "wrap", "plugwrap" etc. herein are interchangeable; the different terms are used merely to help avoid confusion between two or more separate items of the same nature without implying that they cannot be similar or identical; unless the text concerned does not permit it, any "sleeve" or "plugwrap" etc. referred to could, for example, be a seamless extruded tube or a wrap secured by a lapped and stuck seam, etc.

BRIEF DESCRIPTION OF THE DRAWINGS

The invention is illustrated, by way of example only, by the following description of one embodiment to be taken in conjunction with the accompanying drawings, in which.

DETAILED DESCRIPTION

Figure 1:
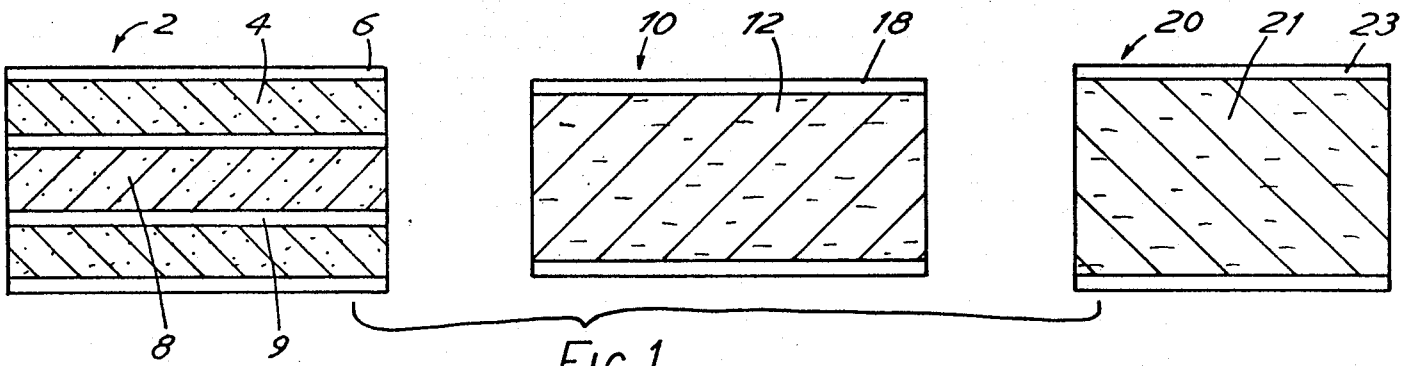
FIG. 1 shows in exploded longitudinal section, the individual core members of the mouthpiece.

In the drawings, the buccal end core member 2 has an outer body 4 of annular section made of filtering material (e.g. cellulose acetate tow) usually but not necessarily in a plugwrap 6, the outer filtering body 4 snugly surrounding a complementary inner core portion 8 which is movable longitudinally relative to filter body 4. The inner core 8 could, for example be a rod of cellulose acetate tow, preferably wrapped in an acetate or like film 9 to facilitate sliding relative to outer body 4—though being a snug fit in body 4 to reduce the risk of accidental dislodgement.

Figure 2:
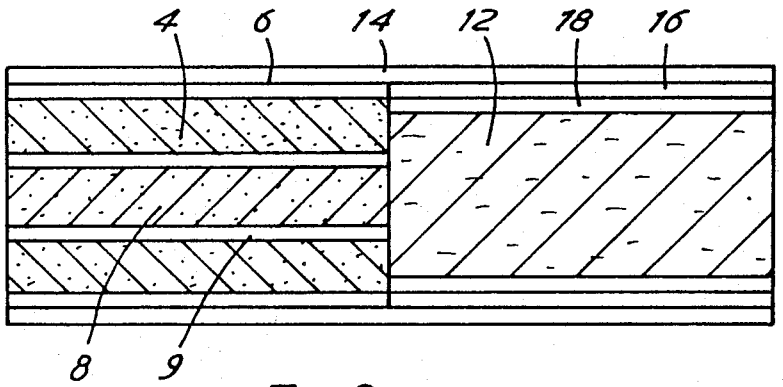
FIGS. 2 and 3 are similar views of these core members as assembled during formation of the mouthpiece.

Adjacent upstream core member 10 suitably has a conventional filter plug 12 and is shown in FIG. 2 combined with buccal end core member 2 by means of a common air-permeable plugwrap 14. Plug 12 is preferably formed with an air-permeable wrap or sleeve 16, common plugwrap 14 being adhered to buccal end core member 2 and to wrap or sleeve 16 and plug 12 fitting snugly in but being slidable relative to wrap or sleeve 16; to facilitate such sliding, plug 12 preferably has a smooth plastics wrap 18, plug 12 and plastics wrap 18 thus constituting the adjacent upstream core member 10.

Figure 3:
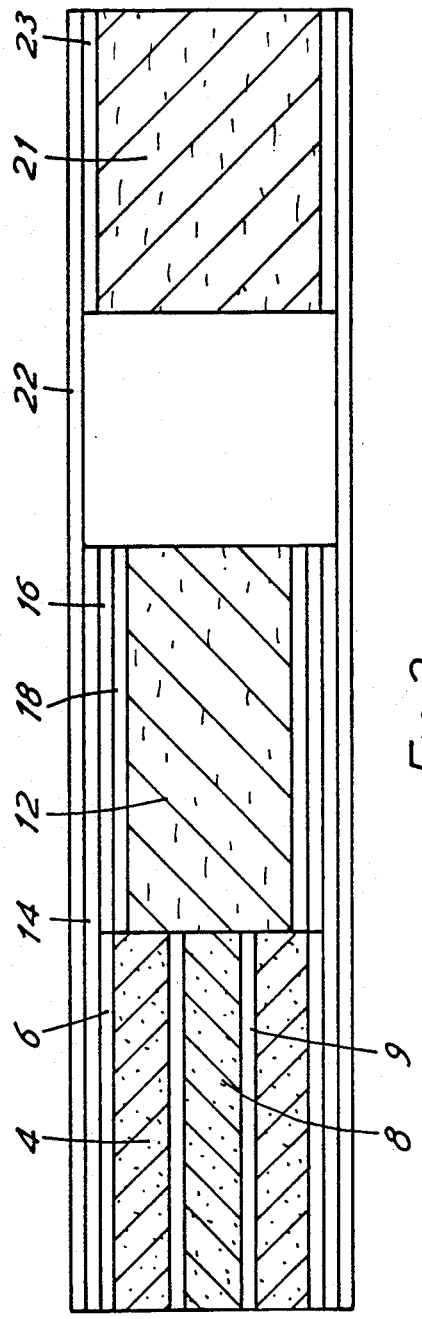

The third core member 20 may be a conventional filter plug 21, usually, but not necessarily provided with a plugwrap 23, and is shown in FIG. 3 longitudinally spaced from the FIG. 2 combination of buccal end and adjacent upstream core members and united therewith by a highly-ventilating common wrap 22. This common wrap 22 might, for example be a plugwrap of highly porous material, a plugwrap having numerous and/or large ventilating vents, or one or more partial plugwraps or strips. This highly ventilating wrap or partial wrap 22 is preferably secured (e.g. adhered) to the core member 20 and to the common wrap 14 so that these are fixed relative to one another.

Figure 4:
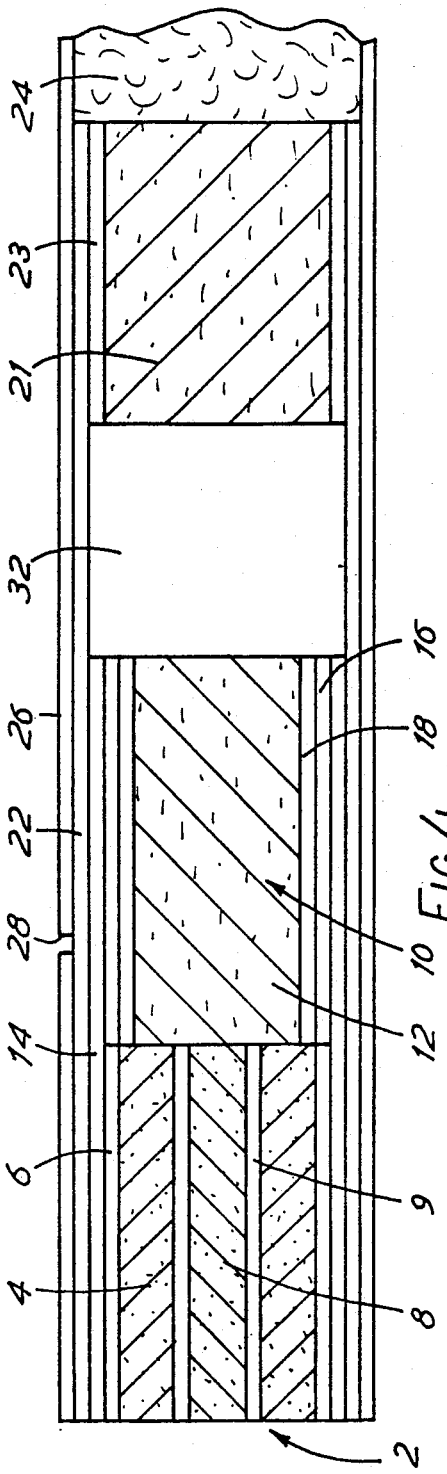
FIGS. 4 and 5 are similar views of the completed mouthpiece incorporated in a cigarette respectively before and after adjustment of the degree of ventilation.
Figure 5:
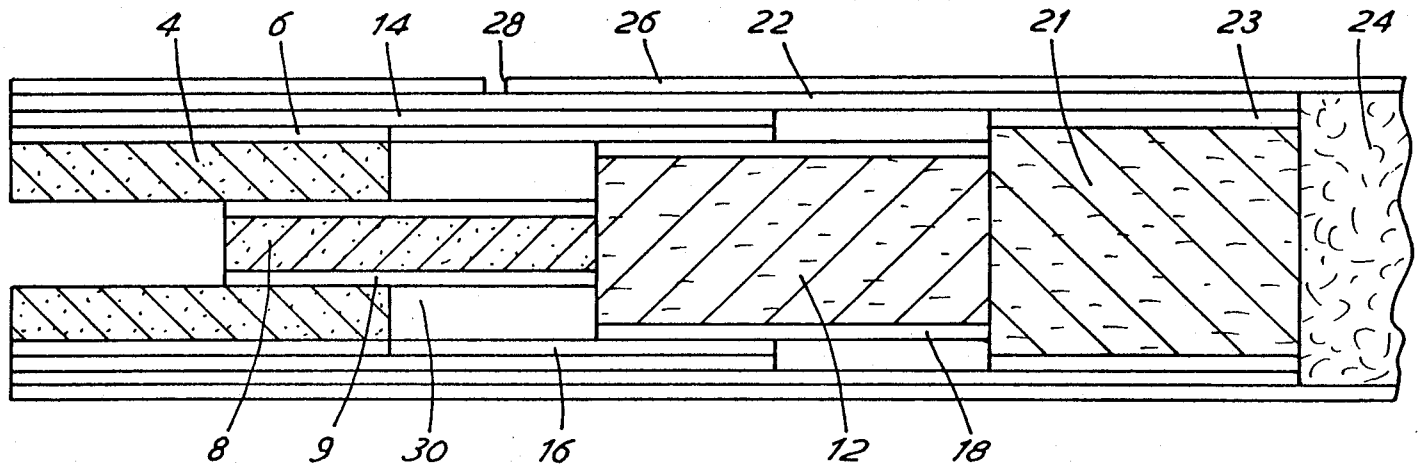

FIGS. 4 and 5 show the FIG. 3 assembly attached to a tobacco rod 24 by means of the outer ventilating sleeve 26 which completes this embodiment of the mouthpiece according to the invention. In the embodiment illustrated, the sleeve 26 has vents 28 in register with the air-permeable wrap or sleeve 16 and upstream core member 10, the vents thus being blocked to substantially prevent air dilution of smoke passing through the mouthpiece in use. As shown in FIG. 5, however, the inner core portion 8 of buccal end core member 2 can be moved longitudinally upstream to move upstream core member 10 out of blocking registration with the vents 28, allowing ventilation into the resulting cavity 30. In another embodiment, the vents 28 are initially in register with the cavity 32 between core members 10 and 20, the movement of the core member 10 under the action of the inner core portion 8 then bringing the core portion 10 into blocking registration with the vents to prevent or reduce ventilation. Numerous variations are possible to provide for different amounts of change in degree of ventilation.

Figure 6:
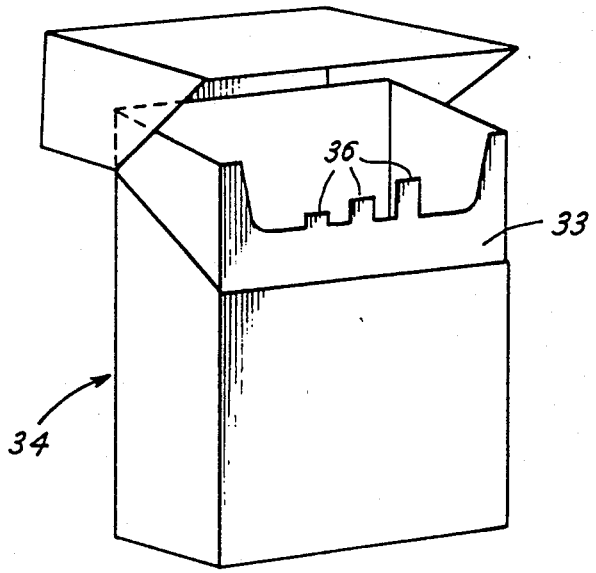
FIG. 6 is a perspective view of a cigarette packet provided with means for ready adjustment of the mouthpiece ventilation.

The inner core portion 8 of buccal end core member 2 is readily operated by conveniently available means such as a pencil or pen tip, but adjusting means could also be provided on the carton in which the cigarettes are packed. This is illustrated in FIG. 6, where the frame board 33 of a flip top pack 34 is stamped to provide one or more projections 36 of suitable dimensions; the buccal end of the mouthpiece is simply pushed down over the appropriate projection for the amount of ventilation adjustment required.

The following is a specific example of a variable ventilation filter and filter cigarette according to the invention of the type illustrated in FIGS. 1 to 5.

The pressure drops (PD) quoted herein are measured by the accepted procedure recommended by CORESTA (Centre de Cooperation pour les Recherehes Scientifiques Relatives au Tabac). Permeabilities herein are quoted in Filtrona units; an air-permeability of nK Filtrona units (where n is a number) means herein an air-permeability of $n \times 1000$ mls/minute/10 square cms./100 mm.Wg. pressure—as determined by measuring the pressure "p" in mm.Wg. (water gauge) generated by flow of 1050 mls. of air per minute through 10 square cms. of the wrap material under test and calculating from the edquation:

$$\text{air permeability} = 1050 \times \frac{100}{P}$$

The tows referred to in the Example are continuous filamentary tows of cellulose acetate; a reference to a B/C tow means one having a filament denier of B and a total denier of 1000 C—i.e. a 15/45 tow has a filament denier of 15 and a tow denier of $45 \times 10^3$.

| EXAMPLE | |
|---|---|
| FIG. 1 Members | |
| Buccal end core member 2 | length 9 mm<br>PD 23 mm<br>Inner core portion 8 - 15/45 tow<br>wrap 9 - acetate film<br>Body portion 4 - 8/30 tow<br>Plugwrap 6 - permeability 300 K |
| Adjacent Upstream core member 10 | length 6 mm<br>PD 59 mm<br>Plug 12 - "Myria" (creped paper)<br>Wrap 18 - polypropylene film<br>Wrap 16 - permeability 650 K |
| Third Core member 20 | length 5 mm<br>PD 90 mm<br>Plug 21 - 15/45 tow<br>Plugwrap 23 - standard |
| FIG. 2 Assembly | length 15 mm<br>PD 90 mm<br>Plugwrap 14 - permeabilty 650 K |
| FIG. 3 Assembly | length 25 mm (cavity 5 mm)<br>PD 99 mm<br>Wrap 22 - heat sealed part wrap |
| FIGS. 4 and 5 | Performance of filter cigarette (summarized in Table 1 below): |

TABLE 1

| | Before Adjustment FIG. 4 | After Adjustment FIG. 5 |
|---|---|---|
| Cigarette Pressure Drop (vents open) mm | 139 | 72 |
| Cigarette Pressure Drop (vents closed) mm | 150 | 130 |
| Tip Ventilation % | 13.1 | 50 |
| Cigarette Wrapper/envelope ventilation % | 10.8 | 5.3 |
| TPM(WNF) Yield mg/cig | 11.2 | 6.3 |
| Nicotine Yield mg/cig | 0.96 | 0.63 |
| CO Yield mg/cig | 13.2 | 6.4 |

All of the PD's quoted herein are the "enclosed" or "non-ventilated" values (i.e. measured with ventilation prevented by an impermeable sleeve around the test item), except for the "vents open" values in Table 1.

While the illustrated embodiment shows the outer ventilating sleeve having a single row of ventilating perforations, other vent arrangements are, of course possible. There could, for example, be two or more longitudinally spaced rings of ventilating perforations, and the sleeve could additionally or instead have larger vents—e.g. ventilating slots.

As previously indicated, the illustrated core members of FIG. 1 (and core member 10 plus air permeable wrap 16), and the sub-assemblies of FIGS. 2 and 3, may be made from continuously produced rods, and the invention includes the sub-assemblies per se as well as any initial continuous and intermediate multiple length rods from which they are cut.

The invention also includes a cigarette packet having a frame board with at least one projection on its free edge for operatively engaging the movable portion of the buccal end core member of a mouthpiece according to the invention.

We claim:

1. A ventilated smoker's mouthpiece, comprising:

a cylindrical buccal end core member comprising a radially outer tubular portion snugly slidably surrounding a radially inner portion disposed coaxially therewith; said buccal end core member having a first end and a second end; at least one of said radially outer tubular portion and said radially inner portion being capable of having smoke and air drawn longitudinally therethrough and out said first end of said buccal end core member;

a cylindrical second core member comprising a cylindrical plug of cigarette filter material through which cigarette smoke may be drawn longitudinally while being filtered; said second core member having a first end and a second end; said second core member being coaxially arranged with said buccal end core member with said second end of said buccal end core member disposed adjacent said first end of said second core member; said second core member further including an air-impervious outer peripheral wrap;

a ventilating outer sleeve engagingly peripherally surrounding said buccal end core member and said second core member thereby securing said radially outer tubular member of said buccal end core member in relation to said second core member; said second core member being snugly longitudinally slidably received in relation to said ventilating outer sleeve; said ventilating outer sleeve being radially pervious to air towards said second core member adjacent said first end of said second core member adjacent said second end of said buccal end core member;

said radially inner portion of said buccal end core member being externally accessible from said first end of said buccal end core member, so that said radially inner portion may be pushed axially upstream relative to said radially outer tubular portion, and thereby push the second core member axially upstream relative to the ventilating outer sleeve, from an initial position in which said air-impervious outer peripheral wrap to a first, greater degree prevents air from being drawn through said ventilating outer sleeve by suction on said first end of said buccal end core member, to a variably selected use position in which said air-impervious outer peripheral wrap to a second, lesser degree prevents air from being drawn through said ventilating outer sleeve by suction on said first end of said buccal end core member; and means permitting attachment of said ventilated smoker's mouthpiece to a cigarette so that said second end of said second core member is disposed nearest the cigarette, so that a user may push-in the radially inner core portion by a selected amount in order to regulate the proportion of air and smoke which is drawn through the first end of said buccal end core member by sucking thereon while the cigarette is attached to the ventilated smoker's mouthpiece and being smoked by the user.

2. The ventilated smoker's mouthpiece of claim 1, further including:

a cylindrical third core member comprising a cylindrical plug of cigarette filter material through which cigarette smoke may be drawn longitudinally while being filtered; said third core member having a first end and a second end; said third core member being coaxially arranged with said second core member with said first end of said third core member disposed adjacent said second end of said second core member; and wrapping means peripherally wrapping said third core member and whereby operatively securing said third core member to said radially outer portion of said buccal end core member.

3. The ventilated smoker's mouthpiece of claim 2, wherein:

said wrapping means is constituted by a respective portion of said ventilating outer sleeve.

4. The ventilated smoker's mouthpiece of claim 3, wherein:

when said radially inner member of said buccal end core portion is in said initial position, said second end of said second core member is disposed with longitudinal spacing from said first end of said third core member.

5. The ventilated smoker's mouthpiece of claim 2, wherein:

when said radially inner member of said buccal end core portion is in said initial position, said second end of said second core member is disposed with longitudinal spacing from said first end of said third core member.

6. A filter tip cigarette, comprising:

a cylindrical buccal end core member comprising a radially outer tubular portion snugly slidably surrounding a radially inner portion disposed co-axially therewith; said buccal end core member having a first end and a second end; at least one of said radially outer tubular portion and said radially inner portion being capable of having smoke and air drawn longitudinally therethrough and out said first end of said buccal end core member;

a cylindrical second core member comprising a cylindrical plug of cigarette filter material through which cigarette smoke may be drawn longitudinally while being filtered; said second core member having a first end and a second end; said second core member being coaxially arranged with said buccal end core member with said second end of said buccal end core member disposed adjacent said first end of said second core member; said second core member further including an air-impervious outer peripheral wrap;

a ventilating outer sleeve engagingly peripherally surrounding said buccal end core member and said second core member thereby securing said radially outer tubular member of said buccal end core member in relation to said second core member; said second core member being snugly longitudinally slidably received in relation to said ventilating outer sleeve; said ventilating outer sleeve being radially pervious to air towards said second core member adjacent said first end of said second core member adjacent said second end of said buccal end core member;

said radially inner portion of said buccal end core member being externally accessible from said first end of said buccal end core member, so that said radially inner portion may be pushed axially upstream relative to said radially outer tubular portion, and thereby push the second core member axially upstream relative to the ventilating outer sleeve, from an initial position in which said air-impervious outer peripheral wrap to a first, greater degree prevents air from being drawn through said ventilating outer sleeve by suction on said first end of said buccal end core member, to a variably selected use position in which said air-impervious outer peripheral wrap to a second, lesser degree prevents air from being drawn through said ventilating outer sleeve by suction on said first end of said buccal end core member;

a cigarette having a downstream end; said cigarette being coaxially aligned with said ventilated smoker's mouthpiece, with said downstream and adjacent said second end of said second core member; and means wrappingly attaching said cigarette to said ventilated smoker's mouthpiece so that a user may push-in the radially inner core portion by a selected amount in order to regulate the proportion of air and smoke which is drawn through the first end of said buccal end core member by sucking thereon while the cigarette is being smoked by the user.

7. The filter tip cigarette of claim 6, wherein: said ventilated smoker's mouthpiece further includes:

a cylindrical third core member comprising a cylindrical plug of cigarette filter material through which cigarette smoke may be drawn longitudinally while being filtered; said third core member having a first end and a second end; said third core member being coaxially arranged with said second core member with said first end of said third core member disposed adjacent said second end of said second core member; and wrapping means peripherally wrapping said third core member and thereby operatively securing said third core member to said radially outer portion of said buccal end core member, the third core member thereby being interposed axially between said second end of said second core member and said downstream end of said cigarette.

8. The filter tip cigarette of claim 7, wherein: when said radially inner portion of said buccal end core member is in said initial position, said second end of said second core member is disposed with longitudinal spacing from said first end of said third core member.

9. A ventilated smoker's mouthpiece, comprising:

a buccal end core member comprising a first portion snugly slidably related to a second portion; said buccal end core member having a first end and a second end; at least one of said first portion and said second portion being capable of having smoke and air drawn longitudinally therethrough and out said first end of sadi buccal end core member;

a second core member through which cigarette smoke may be drawn longitudinally; said second core member having a first end and a second end; said second core member being arranged with said first end thereof disposed adjacent said second end of said buccal end core member;

a ventilating outer sleeve engagingly peripherally surrounding said buccal end core member and said second core member; and said second portion of said buccal end core member being externally accessible from said first end of said buccal end core member, so that one said portion may be moved axially relative to the other from an initial relative position, to a variably-selected use position.

10. The ventilated smoker's mouthpiece of claim 9, further including:

a third core member through which cigarette smoke may be drawn longitudinally; said third core member having a first end and a second end; said third core member being arranged with said first end thereof disposed longitudinally spacedly adjacent said second end of said second core member; and means operatively securing said third core member to said first portion of said buccal end core member.

11. The ventilated smoker's mouthpiece of claim 10, wherein:

said securing means is constituted by a respective portion of said ventilating outer sleeve.

12. A ventilated smoker's mouthpiece, comprising:

a buccal end core member comprising a first portion snugly slidably related to a second portion; said buccal end core member having a first end and a second end; at least one of said first portion and said second portion being capable of having smoke and air drawn longitudinally therethrough and out said first end of said buccal end core member;

a second core member through which cigarette smoke may be drawn longitudinally; said second core member having a first end and a second end; said second core member being arranged with said first end thereof disposed adjacent said second end of said buccal end core member;

a ventilating outer sleeve engagingly peripherally surrounding said buccal end core member and said second core member; and said second core member further including an air-impervious outer peripheral wrap;

said second portion of said buccal end core member being externally accessible from said first end of said buccal end core member, so that one said portion may be moved axially relative to the other said portion, thereby moving the second core member axially relative to the ventilating outer sleeve, from an initial position in which said air-impervious outer peripheral wrap to a first degree controls air being drawn through said ventilating outer sleeve by suction on said first end of said buccal end core member, to a variably selected use position in which said air-impervious outer peripheral wrap to a second, differing degree controls air being drawn through said ventilating outer sleeve by suction on said first end of said buccal end core member.

13. Stock for providing a plurality of ventilated smoker's mouthpieces, comprising:

a plurality of buccal end core members each comprising a first portion snugly slidably related to a second portion; each said buccal end core member having a first end and a second end; at least one of said first portion and said second portion of each said buccal end core members being capable of having smoke and air drawn longitudinally therethrough and out said first end of the respective said buccal end core member;

a plurality of second core members through which cigarette smoke may be drawn longitudinally; each said second core member having a first end and a second end; each said second core member being arranged with said second end of a respective said buccal end core member disposed adjacent said first end of a respective said second core member;

said buccal end core members and said second core members being arranged in a series of longitudinally successive mirror image like groups beginning with a second core member, then a buccal end core member, then another buccal end core member and then another second core member;

a ventilating outer sleeve engagingly peripherally surrounding all of said buccal end core members and all of said second core members in said series;

said second portion of each buccal end core member, when each said group is severed from all others of said groups in said series by cutting transversally through said ventilating outer sleeve, being externally accessible from said first end of said buccal end core member, so that one said portion may be moved axially relative to the other said portion, to thereby move the second core member axially relative to the ventilating outer sleeve, from an initial position, to a variably selected use position.

14. Stock for providing a plurality of ventilated smoker's mouthpieces, comprising:

a plurality of buccal end core members each comprising a first portion snugly slidably related to a second portion; each said buccal end core member having a first end and a second end; at least one of said first portion and said second portion of each said buccal end core members being capable of having smoke and air drawn longitudinally therethrough and out of said first end of the respective said buccal end core member;

a plurality of second core members through which cigarette smoke may be drawn longitudinally; each said second core member having a first end and a second end; each said second core member being arranged with said second end of a respective said buccal end core member disposed adjacent said first end of a respective said second core member;

a plurality of third core members through which cigarette smoke may be drawn longitudinally; each said third core member having a first end and a second end; each said third core member being arranged with said first end thereof disposed longitudinally spacedly adjacent said second end of a respective said second core member;

said buccal end core members, said second core members and said third core members being arranged in a series of longitudinally successive mirror image like groups beginning with a third core member, then a second core member, then a buccal end core member, then another buccal end core member, then another second core member, and then another third core member;

a ventilating outer sleeve engagingly peripherally surrounding all of said buccal end core members, all of said second core members and all of said third core members in said series;

said second portion of each buccal end core member, when each said group is severed from all others of said groups in said series by cutting transversally through said ventilating outer sleeve, being externally accessible from said first end of said buccal end core member, so that one said portion may be moved axially relative to the other said portion, to thereby move the second core member axially relative to the ventilating outer sleeve, from an initial position, to a variably selected use position.

* * * * *